US010138080B2

(12) United States Patent
Schneider et al.

(10) Patent No.: US 10,138,080 B2
(45) Date of Patent: Nov. 27, 2018

(54) APPARATUS FOR SEPARATING SHEET MATERIAL

(71) Applicant: GIESECKE+DEVRIENT CURRENCY TECHNOLOGY GMBH, München (DE)

(72) Inventors: Stefan Schneider, Kirchheim (DE); Roland Kopp, Olching (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/735,004

(22) PCT Filed: Jun. 7, 2016

(86) PCT No.: PCT/EP2016/000937
§ 371 (c)(1),
(2) Date: Dec. 8, 2017

(87) PCT Pub. No.: WO2016/198157
PCT Pub. Date: Dec. 15, 2016

(65) Prior Publication Data

US 2018/0162666 A1 Jun. 14, 2018

(30) Foreign Application Priority Data

Jun. 9, 2015 (DE) ..... 10 2015 007 463

(51) Int. Cl.
*B65H 1/26* (2006.01)
*B65H 7/06* (2006.01)
*B65H 7/14* (2006.01)

(52) U.S. Cl.
CPC ..... *B65H 1/263* (2013.01); *B65H 7/06* (2013.01); *B65H 7/14* (2013.01); *B65H 2511/51* (2013.01);
(Continued)

(58) Field of Classification Search
CPC ..... B65H 1/263; B65H 7/06; B65H 2511/51; B65H 2511/52; B65H 2701/1912; B65H 1/30; B65H 1/26; B65H 7/02; B65H 7/14
See application file for complete search history.

(56) References Cited

U.S. PATENT DOCUMENTS 5,803,446 A * 9/1998 Leuthold ..... B65H 1/30 271/159
7,874,554 B2 1/2011 Dopfer et al.
(Continued)

FOREIGN PATENT DOCUMENTS

DE 8632366 U1 1/1987
DE 10250666 A1 5/2004
(Continued)

OTHER PUBLICATIONS

German Search Report from DE Application No. DE 10 2015 007 463.6, dated Mar. 7, 2016.
(Continued)

*Primary Examiner* — David H Bollinger
(74) *Attorney, Agent, or Firm* — Workman Nydegger

(57) ABSTRACT

An apparatus for the continuous singling of stacks of loose sheet goods comprises a singler for singling stacks of loose sheet goods and a feeding device having two feeding elements, moving stacks of loose sheet goods to be singled into a position where sheet goods are grasped by the singler and transferred to a transport system, and an area for receiving sheet goods to be singled with first and second subareas. The first and second subareas border each other, and the second subarea forms an input area for the sheet goods. The first feeding element moves within the total area, between the first and third positions, and forms an end position, at least, however, in the first subarea, between a second one and the third position. A monitoring device is provided for the first
(Continued)

subarea for ascertaining bank notes in the first subarea underneath the first feeding element.

7 Claims, 4 Drawing Sheets

(52) U.S. Cl.
CPC .. *B65H 2511/52* (2013.01); *B65H 2701/1912* (2013.01)

(56) References Cited

U.S. PATENT DOCUMENTS

| | | | |
|---|---|---|---|
| 8,172,221 | B2 | 5/2012 | Monch et al. |
| 8,695,968 | B2 | 4/2014 | Dopfer et al. |
| 9,074,884 | B2 | 7/2015 | Buchel |
| 2007/0023989 | A1 | 2/2007 | Dopfer et al. |
| 2010/0187748 | A1 | 7/2010 | Monch et al. |
| 2010/0194029 | A1 | 8/2010 | Dopfer et al. |
| 2014/0002806 | A1 | 1/2014 | Buchel |
| 2016/0090249 | A1* | 3/2016 | Suzuki ..... B65H 3/0883 271/9.08 |

FOREIGN PATENT DOCUMENTS

| | | | |
|---|---|---|---|
| DE | 10330107 | A1 | 4/2005 |
| DE | 102007043129 | A1 | 3/2009 |
| JP | 2015056126 | A | 3/2015 |
| WO | 2009033655 | A1 | 3/2009 |
| WO | 2012127017 | A1 | 9/2012 |

OTHER PUBLICATIONS

International Search Report from PCT Application No. PCT/EP2016/000937. dated Sep. 9, 2016.

* cited by examiner

APPARATUS FOR SEPARATING SHEET MATERIAL

BACKGROUND

The invention relates to an apparatus for the continuous singling of stacks of loose sheet goods, in particular bank notes, vouchers, checks, separation cards etc.

Upon the processing of bank notes with bank-note processing machines, great importance is attached to the preparation of bank notes to be processed, in particular to the optimally trouble-free inserting of loose bank notes into an input pocket of a singler of the employed bank-note processing machine. As a rule, the loose bank notes are formed by an operator into stacks which are inserted into the input pocket of the singler in order that the bank notes can be grasped individually by the singler. The individual bank notes are subsequently processed in the bank-note processing machine. For this purpose, the properties of the bank notes are ascertained by sensors, for example their type, i.e. denomination and currency, their authenticity, their state, i.e. soiling, defects, etc., their suitability for further circulation, their position and orientation etc. Further processing of the bank notes is effected in dependence on the ascertained properties, e.g. they are sorted into certain output pockets or destroyed by means of a shredder if the bank notes are too damaged or soiled so as to no longer be suitable for further circulation.

If it is necessary to separate different groups of bank notes from each other, e.g. bank notes coming from different depositors, so-called separation cards are inserted between the bank notes of the different depositors. These separation cards can be recognized by the sensors of the employed bank-note processing machine to separate the bank notes of the different deposits from each other. The separation cards can furthermore have information which can likewise be detected by the sensors, which characterizes the different depositors, so that the different deposits can be associated with the particular depositor.

From WO 2009/033655 A1 there is known an apparatus for singling sheet goods wherein sheet goods to be singled are put into an input pocket. The input pocket is engaged by two feeding elements of rake-like configuration moving vertically and horizontally within the input pocket which effectuate that the singling of sheet goods can be effected without interruption, because further sheet goods can already be inserted into the input pocket when the previously inserted sheet goods have not yet been completely singled. For this purpose, the described feeding element alternatingly engage the input pocket and alternatingly transport sheet goods into the singling position. To enlarge the restricted receiving capacity of the input pocket, an area is provided for the receiving of sheet goods to be singled, which is divided into a first subarea and a second subarea, which forms the input pocket, wherein first and second subarea border on each other. Due to the first subarea bordering on the input pocket, the intake capacity of the apparatus for the continuous singling of sheet goods is substantially increased so that substantially more sheet goods can be inputted than into the input pocket alone.

With the known apparatus it has turned out, however, that the area enlarged by the first subarea can cause problems for the receiving of sheet goods upon the processing because it can occur that sheet goods undesirably leave the first subarea, which is why these sheet goods cannot be processed properly.

SUMMARY

Starting out from this prior art, the invention is based on the object of specifying an apparatus for the continuous singling of stacks of loose sheet goods, in particular bank notes, vouchers, checks, separation cards etc., for which an error-free and proper processing of sheet goods is possible.

The invention is based on the finding that in an apparatus for the continuous singling of loose sheet goods, having a singler for singling stacks of loose sheet goods and a feeding device having two feeding elements, which moves stacks of loose sheet goods to be singled into a position where sheet goods are grasped by the singler and transferred to a transport system, and an area for the receiving sheet goods to be singled, having a first subarea and a second subarea, wherein first and second subarea border on each other and the second subarea forms an input area for inputting sheet goods to be singled, wherein the first feeding element is arranged in the area and moves within the total area, between the first position and a third position, which forms an end position, at least, however, in the first subarea, between a second and the third position, wherein the second position separates the first subarea from the second, a monitoring device is provided for the first subarea, for ascertaining bank notes located in the first subarea underneath the first feeding element.

The advantage of the inventive solution consists in the fact that by means of the monitoring device it can be ensured for the first subarea that upon the processing of sheet goods, no sheet goods can be in the first subarea underneath the first feeding element. Therefore, a fault-free and proper processing of the sheet goods is ascertained because it can be thus attained that indeed all pieces of the sheet goods to be processed are processed.

BRIEF DESCRIPTION OF THE DRAWINGS

Further embodiments and advantages of the invention will hereinafter be explained with reference to the figures and their description.

There are shown

DETAILED DESCRIPTION OF VARIOUS EMBODIMENTS

FIG. 1 shows an embodiment of an apparatus for the continuous singling of sheet goods at different processing times during the inserting and the singling of sheet goods.

Figure 1A:
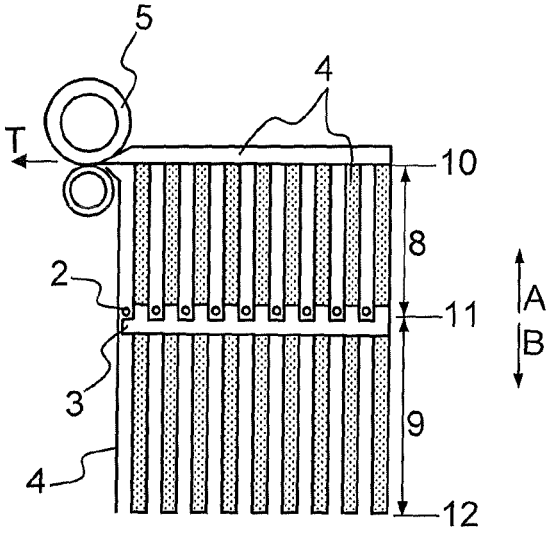
FIGS. 1(*a*) to 1(*l*) embodiments of an apparatus for the continuous singling of sheet goods at different processing times, FIG. 2 a machine for processing sheet goods, in particular a bank-note processing machine, having an apparatus for the continuous singling of sheet goods, in particular bank notes, and FIG. 3 an embodiment of a monitoring device for the apparatus for the continuous singling of sheet goods.

FIG. 1*a* shows the apparatus for the continuous singling of sheet goods without sheet goods. The apparatus has a singler 5 which grasps sheet goods individually and transfers them to a transport system (not shown in detail) which transports the singled sheet goods for further processing in a direction indicated by arrow direction T. Limiting and guiding elements 4 form an area 8, 9 in which sheet goods to be singled can be present. The limiting and guiding elements 4 can be constructed for example from sheet metal parts. In the area 8, 9 formed by the limiting and guiding elements 4 there is disposed a feeding device comprising two feeding elements 2, 3 which feed bank notes to be singled to the singler 5 for singling. For the sake of simplification and better comprehension, the representation of drive elements, e.g. motors, for the feeding device 2, 3 has been omitted.

The first feeding element 3 serves as a deposit area for sheet goods to be singled when the latter are being input to the apparatus. The first feeding element 3 can move along the directions stated as A and B within the area 8, 9, i.e. between a first position 10 and a third position 12, but move at least within a first subarea 9, i.e. between a second position 11 and the third position 12. The second feeding element 2 can move along the directions stated as A and B within a second subarea 8 of the area 8, 9, i.e. between first and second positions 10 and 11. Additionally, the second feeding element 2 can be moved out of the second subarea 8 forming the input area, for example through a motion into the projection plane of the figure. First and second feeding elements 2 and 3 are configured such that they can engage with each other such that the second feeding element 2 can engage between the first feeding element 3 and sheet goods deposited thereon when the second feeding element 2 is moved into the second subarea 8. For example, the feeding elements 2, 3 can have comblike structures which are arranged mutually offset.

Figure 1B:
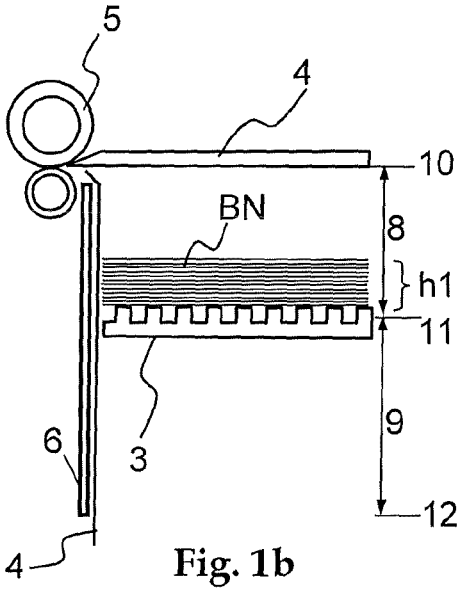

FIG. 1*b* shows the apparatus for the continuous singling of sheet goods in an initial position before the singling of sheet goods. To improve clarity, the limiting and guiding elements 4 are shown only partly in this and in the subsequent figures. The second feeding element 2 has been removed from the second subarea 8 at this time, the first feeding element 3 is located at the second position 11 separating the first and second subareas 8, 9. Therefore, an input area is formed in the second subarea 8 between the first and second positions 10 and 11 into which a stack of sheet goods BN with a height h1 has been inputted. By means of a position sensor 6 it is possible to ascertain the particular position of the feeding elements 2 and 3. Additionally, the position sensor 6 can ascertain the height h1 of the particular input stack of sheet goods. The position sensor 6 can be configured for this purpose, for example as a light barrier which extends substantially over the length of the area 8, 9. The position sensor 6 can also be suited for determining whether an operator is intervening in the second subarea 8 forming the input area, e.g. to insert a stack of sheet goods.

Figure 1C:
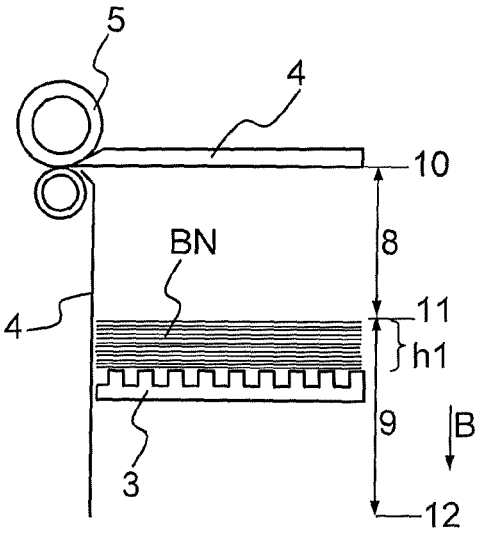

If the position sensor 6 determines that the operator has inserted the stack of sheet goods with the height h1, the first feeding element 3 is moved in direction B by the height h1 of the inserted stack of sheet goods within the first subarea 9, as shown in FIG. 1*c*, such that the last piece of sheet goods of the stack is located at the second position 11. Here, it can be provided that the first feeding element 3 is only moved if the position sensor 6 determines that the operator is no longer intervening in the input area. Alternatively, it can also be provided that the operator starts the motion of the first feeding element 3, e.g. by actuating a corresponding operating element.

Figure 1D:
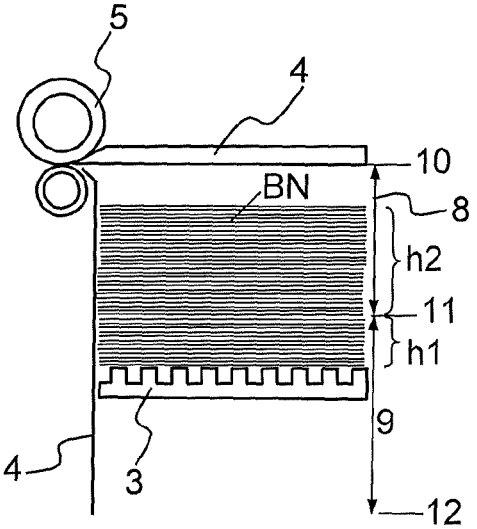

The last piece of sheet goods located at the second position 11 now forms the supporting surface for further sheet goods to be inputted, which can e.g. form a stack with a height h2 as shown in FIG. 1*d*.

Figure 1E:
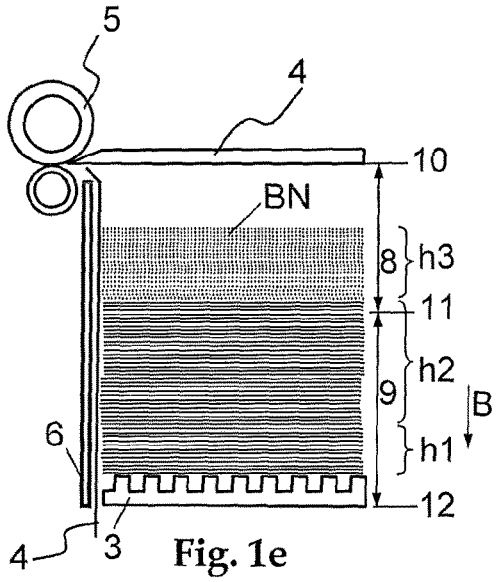
Figure 1F:
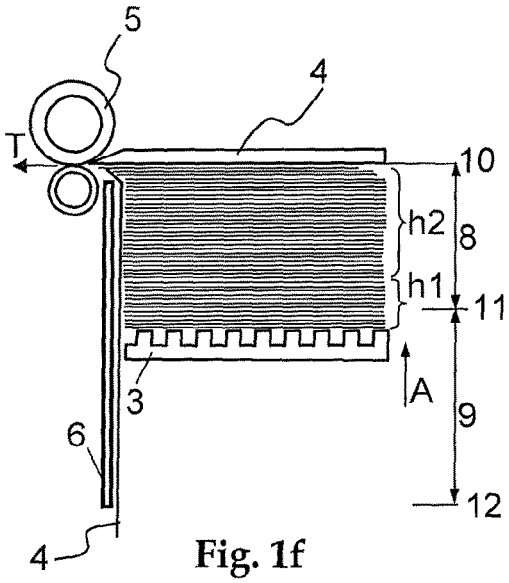

As described hereinabove, the first feeding element 3 is anew moved in direction B, e.g. controlled by means of the signals of the position sensor 6. Corresponding to the height h2 of the last inserted stack of sheet goods. As shown in FIG. 1*e*, the first feeding element 3 has thus reached the third position 12, which constitutes the end position for the motion of the feeding element 3 in direction B. In the now vacant input area (second subarea 8) between the first and second positions 10 and 11 there can now be inserted further sheet goods, e.g. a stack with a height h3.

Subsequently, the first feeding element 3 is moved in the direction A and the sheet goods BN are singled by the singler 5 and transferred to the transport system which transports (FIG. 1*f*) the individual pieces of sheet goods in the direction designated as T for further processing.

Figure 1G:
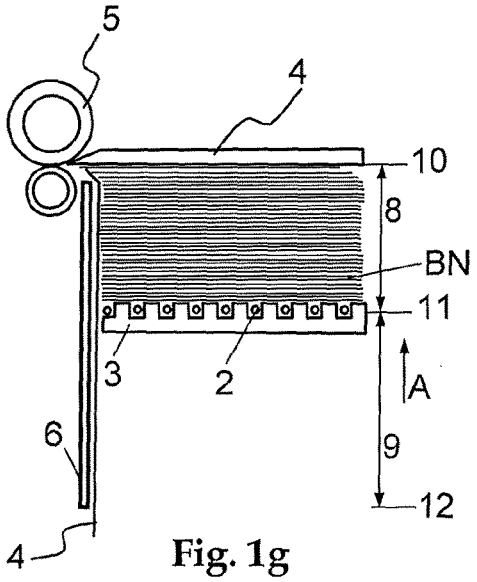
Figure 1H:
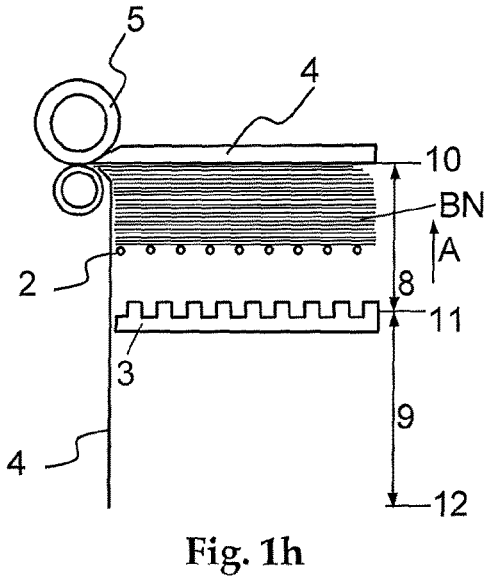

As shown in FIG. 1*g*, the above-described singling is continued until the first feeding element 3 has reached the second position 11. The first feeding element 3 could—as described above—also be moved beyond this position farther in direction A up to the first position 10 to allow the singling of all sheet goods BN, but for the continuous singling it is provided that the second feeding element 2 is inserted into the second subarea 8 forming the input area (FIG. 1*a*) to take over the further transport of the sheet goods to the singler 5. For the sake of completeness it should be mentioned that it is possible that the second feeding element 2 can take over the sheet goods from the first feeding element 3 in the described manner at any place within the second subarea 8, i.e. is not limited to taking over at the second position 11.

Figure 1I:
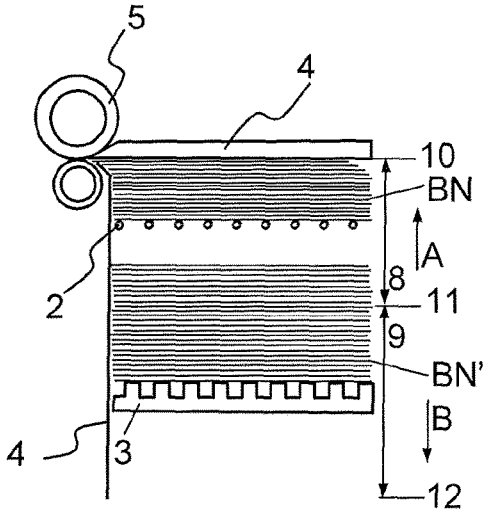

Subsequently the sheet goods are moved by the second feeding element 2 in direction A and fed to the singler 5, while the first feeding element 3 remains at the second position 11. In the area therefore becoming vacant between the first and second feeding elements 2 and 3 (FIG. 1*h*) there can be inserted further sheet goods BN' (FIG. 1*i*). As described above, the intake capacity of the input area (second subarea 8 in FIG. 1*a*) can be increased by moving the first feeding element 3 in direction B by the first subarea 9, between the second and third positions 11 and 12. During the inputting of the further sheet goods BN', there is effected the feeding for continuously singling the previously input sheet goods BN through the second feeding element 2, which continues to be moved in direction A.

Figure 1J:
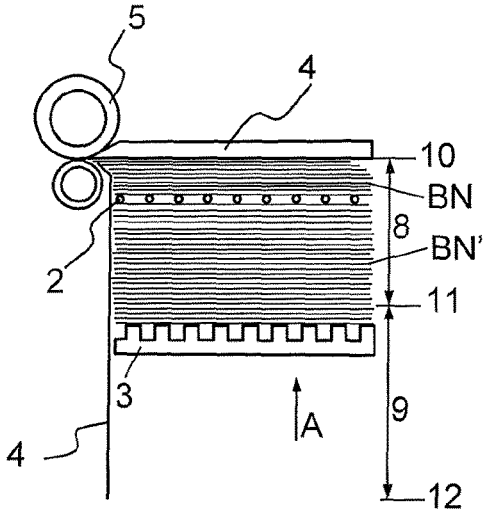

After the termination of the inserting of the further sheet goods BN', the first feeding element 3 is moved in direction A toward the second feeding element 2, as shown in FIG. 1*j*. In so doing, a greater motion speed is chosen for the first feeding element 3 than for the second feeding element 2 as long as the further sheet goods BN' touch the second feeding element 2. Thereafter, the first and second feeding elements 3 and 2 move at the same speed.

Figure 1K:
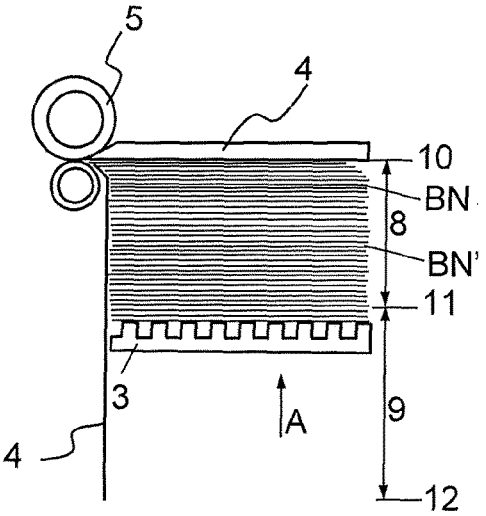
Figure 1L:
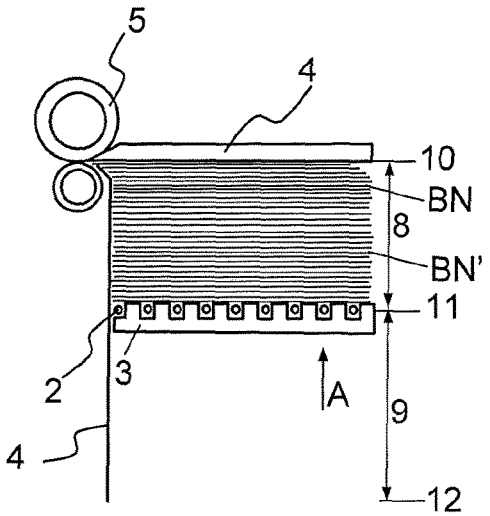

Subsequently, as shown in FIG. 1*k*, the second feeding element 2 is removed from the input area between the first and second positions 10 and 11, whereupon the two stacks of sheet goods BN and BN' are conjoined. For further singling, the conjoined stack of sheet goods BN, BN' is transported by the first feeding element 3 in direction A toward the singler 5. The second feeding element 2 is moved outside the input area to the second position 11.

When the first feeding element 3 reaches the second position 11 (FIG. 1*l*) anew, the sheet goods can again be taken over by the second feeding element 2, by the latter being inserted anew into the input area. The continuous singling can thus be continued while new sheet goods can be inputted into the input area. Should no further sheet goods be inputted, the anew inserting of the second feeding element 2 can be omitted and the sheet goods can continue to be moved to the singler 5 by the first feeding unit 3.

All in all, the first feeding element 3 is thus moved forth and back in single-axis fashion, at least between the second and third positions 11 and 12, wherein a motion up to the first position 10 can also be possible. The second feeding element 2, in contrast, is moved in looplike or multi-axis fashion between the first and second positions 10 and 11, wherein the area between the first and second positions 10 and 11 defines the input area for the inputting of sheet goods by the operator. Instead of an operator, the inputting of sheet goods can also be effected automatically, for example by means of a robot.

Figure 2:
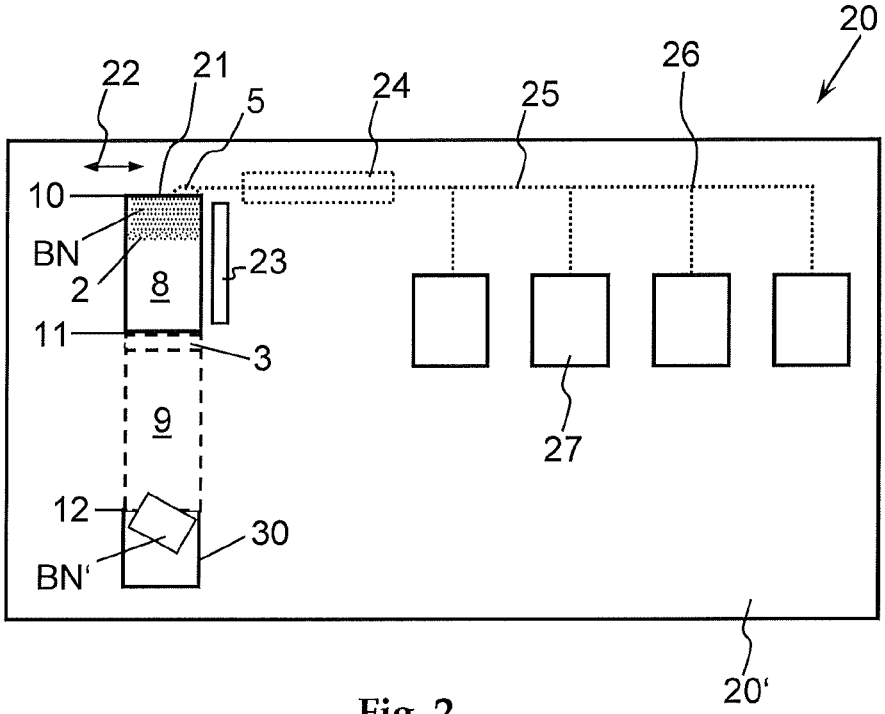

FIG. 2 shows a machine for processing sheet goods 20 having an inventive apparatus for the continuous singling of sheet goods. The machine for processing sheet goods can be in particular a bank-note processing machine with which bank notes, vouchers, checks, separation cards etc., are processed in the above-described way, being in particular checked, sorted and destroyed.

The bank-note processing machine 20 has an input area 8 for inputting bank notes BN. The bank notes BN are singled by a singler 5 and transferred to a transport system 25 which transports the individual bank notes through one or more sensors 24. On the basis of the bank-note signals obtained from the sensor or sensors 24, the particular bank note is checked, wherein for example the authenticity, type (currency, denomination), state (soiling, defects) etc. can be determined. In dependence on the checking, the bank notes are assigned to certain output pockets 27 for which gates 26 guide the particular bank note into the certain output pocket or a shredder in the transport system 25. For controlling the bank-note processing machine 20 and for evaluating the sensor signals, a control device (not shown) can be provided.

Further, the bank-note processing machine has an apparatus for the continuous singling of sheet goods, in particular bank notes, as described above. The apparatus consists of an input area 8 which forms a second subarea for inputting bank notes and is limited by a first and second position 10 and 11. The second subarea 8 is adjoined by a first subarea 9 which is limited by the second position 11 and a third position 12. The first and second subareas 9 and 8 are constructed in like manner for receiving bank notes and have in particular the above-described limiting and guiding elements. For the feeding of bank notes BN to be singled to the singler 5, a feeding device 2, 3 is provided which consists of a first and second feeding element 3 and 2 and can move both within and outside the first and second subareas 9 and 8.

As described above, the first feeding element 3 moves in single-axis fashion at least within the first subarea 9. However, it is also possible that the first feeding element 3 executes its single-axis motion also within the second subarea 8. As likewise described above, the second feeding element 2 carries out a multi-axis, in particular loop-shaped, motion between the first and second positions 10 and 11, wherein a part of the loop-shaped motion is effected outside the second subarea 8. The continuous singling apparatus is likewise controlled by the control device.

For reducing noise caused by the apparatus or the bank-note processing machine 20, a cover 21 can be provided for the input area 8, which is only opened in order that bank notes BN can be inserted into the input area 8. For this purpose, for example a sensor 23 can be present which determines the approach of an operator to the input area and in this case opens the cover 21 in direction 22. Upon an opened cover 21 it can be provided that the first feeding element 3 does not move as long as the operator is intervening into the input area 8 in order that bank notes can be placed on the first feeding element 3. When the operator has moved out of the detection area of the sensor 23 after inserting a first stack of bank notes into the input area 8, the first feeding element 3 is moved into the first subarea 9 normally inaccessible to the operator in the above-described way such that the last sheet of the stack of sheet goods is located at the second position 11. Thereupon the process can be continued as described above and further sheet goods be inserted.

After the process of inserting sheet goods is terminated, the cover 21 can again be closed in direction 22 for noise reduction. For this purpose, it can be determined, for example by means of the sensor 23, whether the operator has no longer intervened into the input area for a specified time period. Instead of the sensor 23, there can also be provided an operating device for starting the motion of the cover 21 and/or of the first feeding element 3, to be actuated by the operator. Likewise, it can be provided to employ the above-described sensor 6 of the apparatus for singling in place of the just described sensor 23.

Because bank notes inputted to the input area 8 are transferred to the first subarea 9 bordering the input area 8, the capacity for receiving bank notes upon inputting the bank notes to the input area 8 is substantially increased, namely by the first subarea 9, which normally is inaccessible because it is closed by the housing 20' of the bank-note processing machine 20 or by a further cover and is inaccessible. Ideally, the location of the second position 11 is moreover chosen such that it is disposed favorably for the operator from an ergonomic point of view upon inputting stacks of bank notes. Therefore the operator can insert large amounts of bank notes into the input area without tiring and with little physical stress, because after the inserting of a stack of bank notes the particular inserted stack is transferred by the first feeding element 3 to the first subarea 9, so that the next stack to be inserted can be inserted at the ergonomically favorable second position 11 again.

As described above in connection with the FIGS. 1*h* and 1*i*, further bank notes BN' can be inserted (FIG. 1*i*) in the now free area between the first and second feeding element 2 and 3 (FIG. 1*h*). Here, it can happen that bank notes BN' unintentionally fall from the first feeding element 3. This can also happen at other times, which is why it can occur that bank notes BN' unintentionally get into the first subarea 9 underneath the first feeding element 3. If the first subarea is not structurally delimited, the bank notes BN' can even leave the first subarea 9 and come to lie only underneath the third position 12 in the housing 20' of the bank-note processing machine 20. A fault-free and proper processing of the bank notes is then not possible any more. This is problematic in particular when deposits consisting of several bank notes are to be processed and credited to a depositor or an account. In this case, the total amount established for the deposit is faulty, i.e. too low, because the bank note or bank notes BN' located in the first subarea 9 underneath the first feeding element 3 cannot be fed to the proper processing by the bank-note processing machine 20. Because, as described hereinabove, as a rule the first subarea 9 is closed by the housing 20' or a further cover, this error cannot be readily recognized and remedied.

For avoiding such processing errors, a monitoring device 30 is provided which adjoins the first subarea 9 in the third position 12. The monitoring unit 30 monitors whether sheet goods, in particular one or several bank notes BN', get into the first subarea 9 as described hereinabove. In this case, the monitoring unit 30 establishes the impermissible presence of the bank note BN' and reports this to the control device of the bank-note processing machine 20. The control device can then generate warning indications on a display of the bank-note processing machine 20 to point out to an operating person the impermissible presence of the bank note BN'.

In this case it can further be provided that the further inputting of bank notes into the input pocket 8 is prevented by the control device. For this purpose, a corresponding indication can for example be generated on the display. Alternatively or additionally, the cover 21 can be closed or not be opened until all bank notes BN located in the input pocket 8 of the presently processed deposit have been processed. Thereafter, the operating person is requested to open the housing 20' or the further cover to check the situation in the first subarea 9. If the operating person finds one or several bank notes BN' upon the checking, said operating person removes these and closes the housing 20' or the further cover. Thereafter, the monitoring device 30 checks anew whether bank notes are present. If no bank notes are determined, the control device can represent an indication over the display that the removed bank notes BN' will be added to the previously processed deposit. This can be effected through an inputting by the operating person using the operating device, e.g. by means of a keyboard or a touchscreen. Electively, the operating person can also insert the removed bank notes BN' into the input pocket 8 so that these are automatically processed by the bank-note processing machine 20 and are credited to the related deposit.

Figure 3:
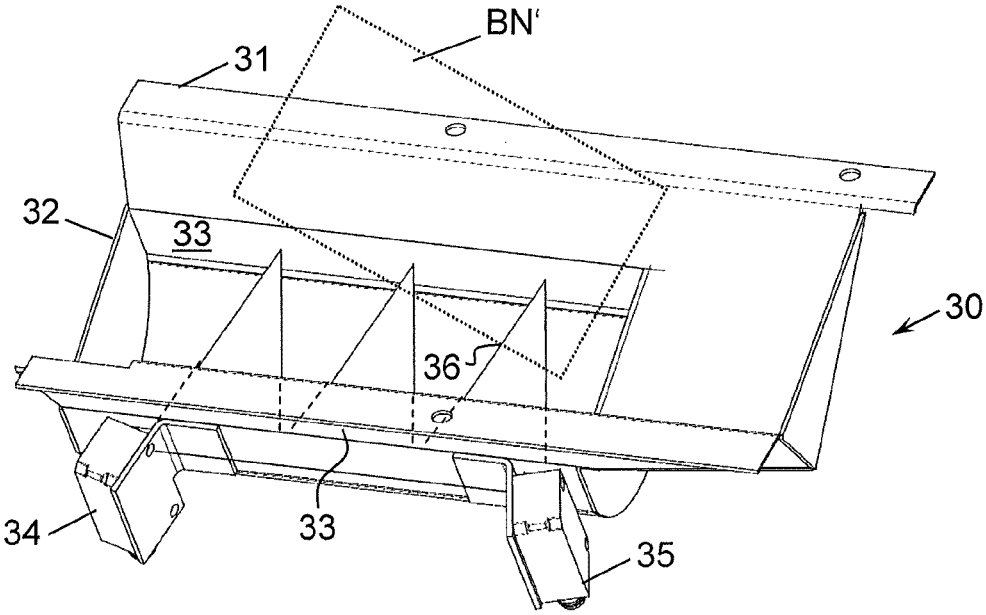

FIG. 3 shows an embodiment of a monitoring device 30 for the apparatus for the continuous singling of sheet goods, in particular bank notes.

The monitoring device 30 is formed by a walling 31, e.g. from metal, which has a depression 32 which e.g. can be funnel-shaped. The depression 32 or parts 33 of the depression can have a reflective surface. A light barrier 34, 35, having a transmitter 34 and receiver 35, is arranged in the area of the depression 32 such that a light ray 36 emanating from the transmitter 34 is reflected in the area of the reflective surface 33 such that it reaches the receiver 35. If a bank note BN' is located in the area of the depression 32, the ray path 36 is interrupted, and the light barrier 34, 35 and the monitoring device 30 reports the presence of the bank note BN' to the control device of the bank-note processing machine 20.

To avoid malfunctions of the monitoring device 30, it can be provided that a cleaning device is arranged in the area of the depression 32. The cleaning device can have suction nozzles which are employed for removing collecting dirt, e.g. dust, in order that this does not incorrectly simulate the presence of a bank note. For this purpose, the suction nozzles can, e.g. in certain time intervals, be subjected to a vacuum in order that the dirt is sucked off. Instead of employing suction nozzles, compressed-air nozzles can be also employed which are subjected, e.g. in certain time intervals, to compressed air to blow off present dirt.

Instead of the above-described light barrier 34, 35, every other sensor or detector can be employed to establish the presence or absence of bank notes, e.g., an ultrasonic transmitter and ultrasonic receiver, a capacitive or inductive proximity sensor etc. By the employment of other sensors or detectors, it can be required to adapt the above-described construction of the walling 31 of the monitoring device 30. For example, by the employment of another material for the walling 31, or by another form.

Deviating from the previous description of the monitoring device 30, in which the monitoring device 30 in the area of the third position 12 adjoins the first subarea 9, the monitoring device can instead or additionally monitor the first subarea 9 for the presence or absence of bank notes BN'. For this purpose it can be provided to integrate the above-described light barrier and/or the other sensors or detectors into the first subarea 9. Here, it is to be noted that only exactly the area of the first subarea 9 is monitored for the unintended presence of bank notes which is located underneath the first feeding element 3. Otherwise the regular presence of the first feeding element 3 and bank notes possibly located thereupon could cause a false report of the monitoring device 30.

The invention claimed is:

1. An apparatus for the continuous singling of loose sheet goods, having a singler for singling stacks of loose sheet goods and a feeding device having two feeding elements, which moves stacks of loose sheet goods to be singled into a position where sheet goods are grasped by the singler and transferred to a transport system, and an area for receiving sheet goods to be singled, having a first subarea and a second subarea, wherein the first and second subareas border on each other and the second subarea forms an input area for inputting sheet goods to be singled, wherein the first feeding element is arranged in the area and moves within the total area, between the first and a third position, which forms an end position, but at least within the first subarea, between a second and the third position, wherein the second position separates the first subarea from the second, wherein a monitoring device for the first subarea, for ascertaining bank notes located in the first subarea underneath the first feeding element.

2. The apparatus according to claim 1, wherein the monitoring device has electively a light barrier, an ultrasonic transmitter and ultrasonic receiver, a capacitive proximity sensor or an inductive proximity sensor.

3. The apparatus according to claim 1, wherein the monitoring device is adjoins the first subarea in the third position.

4. The apparatus according to claim 3, wherein the monitoring device has a depression in which electively a light barrier, an ultrasonic transmitter and ultrasonic receiver, a capacitive proximity sensor or an inductive proximity sensor is arranged.

5. Apparatus according to claim 4, wherein the depression of the monitoring device has one or several reflective area.

6. The apparatus according to claim 1, wherein the monitoring device is equipped with a cleaning device which is formed by compressed-air nozzles and suction nozzles.

7. The apparatus according to claim 1, wherein the apparatus is part of a bank-note processing machine.

* * * * *